US007302219B2

(12) United States Patent
Watanabe et al.

(10) Patent No.: US 7,302,219 B2
(45) Date of Patent: Nov. 27, 2007

(54) FIXING DEVICE

(75) Inventors: Osamu Watanabe, Yokohama (KR); Takashi Ando, Yokohama (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 107 days.

(21) Appl. No.: 11/263,860

(22) Filed: Nov. 2, 2005

(65) Prior Publication Data

US 2006/0093411 A1 May 4, 2006

(30) Foreign Application Priority Data

Nov. 2, 2004 (JP) ..... 2004-319704
Aug. 6, 2005 (KR) ..... 10-2005-0072012

(51) Int. Cl.
*G03G 15/20* (2006.01)

(52) U.S. Cl. ..... 399/327; 399/329

(58) Field of Classification Search ..... 399/320, 399/325, 326, 328, 329; 219/216
See application file for complete search history.

(56) References Cited

U.S. PATENT DOCUMENTS 5,999,764 A * 12/1999 Okabayashi et al. ..... 399/67
6,351,619 B1 * 2/2002 Yamada ..... 399/70
6,594,464 B2 * 7/2003 Hayashi et al. ..... 399/325

FOREIGN PATENT DOCUMENTS

| | | |
|---|---|---|
| JP | 61-018982 | 1/1986 |
| JP | 61-162074 | 7/1986 |
| JP | 10-307502 | 11/1998 |
| JP | 2000-305393 | 11/2000 |
| JP | 2001-159856 | 6/2001 |
| JP | 2004-004920 | 1/2004 |

* cited by examiner

*Primary Examiner*—Hoang Ngo
(74) *Attorney, Agent, or Firm*—Roylance, Abrams, Berdo & Goodman, L.L.P.

(57) ABSTRACT

A fixing device is provided including a plurality of supporters, an endless belt movably supported by the supporters in a main direction, a heat source which heats the endless belt, and a pressing element which presses on the endless belt. Two bridging portions of the belt extend between the supporters, one bridging portion is tensed, the other bridging portion is tense-free. A fixing nip is formed by contacting the pressing element with an outer surface of the tensed bridging portion. The fixing device further includes a heat source which heats a rounding portion of the belt that is wound around a supporter on an upstream side and a cleaning mechanism which cleans a surface of the rounding portion.

18 Claims, 3 Drawing Sheets

FIXING DEVICE

CROSS-REFERENCE TO RELATED PATENT APPLICATIONS

This application claims the benefit under 35 U.S.C. § 119(a) of Japanese Patent Application No. P2004-319704, filed on Nov. 2, 2004, and Korean Patent Application No. 10-2005-0072012, filed on Aug. 6, 2005, the entire disclosures of which are hereby incorporated by reference.

BACKGROUND OF THE INVENTION

1. Field of the Invention

The present invention relates to a fixing device. More particularly, the present invention relates to a fixing device arranged in a photolithographic image forming apparatus such as a laser printer, a laser facsimile, or a digital copier.

2. Description of the Related Art

In electrophotographic image forming apparatuses, the surface of a photoconductor drum is charged and then scanned by a laser scanning unit or the like to form an electrostatic latent image according to an image signal. Thereafter, charged toner is attached onto the photoconductor drum and developed by a developer to form a toner image. Then, the toner image is transferred to a paper sheet (recording medium). The toner image transferred to the paper sheet is seated on the sheet, that is, not fixed thereto, and the toner image is then fused with heat and pressure to fix the paper sheet by a fixing device.

A conventional fixing device basically includes a cylindrical metallic heat roller (an electrical heating element), a press roller (a pressing element) which presses and contacts the heat roller, and a halogen lamp (a heat source) installed in the heat roller to heat the heat roller with radiant heat. In the fixing device (2-roller type), the paper sheet having a toner image formed thereon is passed through a fixing nip formed between the heat roller and the press roller, which contact with each other with pressure, so that the toner image is heated by the heat roller and pressed on and fixed to the sheet by the pressure contact of the heat roller and the press roller.

However, it takes a rather long period of time for a conventional fixing device to heat the heat roller at room temperature to reach a fixing temperature of about 160 to 200° C. at which toner melts. Hence, a conventional fixing device spends a significantly long warm-up time before actual printing after power application. Furthermore, the fixing device maintains its temperature high because this shortens the time interval between print standby and print start. The fixing device needs to be heated with a halogen lamp to keep its temperature high. This results in increased power consumption.

To overcome these disadvantages of the conventional 2-roller type fixing device there have been recent proposals for fixing devices capable of reducing both warm-up time and power consumption.

One of the proposed fixing devices is an induction heating (IH) fixing device which achieves heat generation by inducing current using magnetic flux. The IH fixing device basically includes a cylindrical or half-cylindrical holder, a cylindrical film fits into the holder comprising a stack of conductive and resistor layers, a magnetic field generating unit installed in the holder and comprised of an excitation coil and a magnetic core, and a press roller that presses and contacts an outer circumference of the film to form a fixing nip. In the IH fixing device, an Eddy current is generated by the magnetic flux generated by the magnetic field generating unit. As a result, Joule's heat is generated on the conductive layer by the Eddy current, and the temperature of the fixing nip is increased by the Joule's heat. Due to the IH, the temperature of the fixing nip can be increased to a fixing temperature within a short time period, and the warm-up time period can be reduced. Furthermore, as described in Japanese Patent Publication No. 2004-126274, the entire disclosure of which is hereby incorporated by reference, power consumption can be reduced because the cylindrical film has a low heat capacity compared to a heat roller. However, because the IH fixing device needs the magnetic field generating unit, it requires high costs for components compared to the 2-roller type fixing device. Moreover, because the inner surface of the film slides on a component such as the holder, the durability of the film is restricted due to abrasion of the holder portion on which the film slides. Therefore, the selection range of a material for the film is relatively narrow.

There is also a press belt pressing type fixing device in which a tube-shaped press belt is included instead of the press roller included in the 2-roller type fixing device. A fixing nip is formed by pressing a part of the inner surface of the press belt toward a heat roller so that the outer surface of the press belt corresponding to the pressed inner surface portion contacts the heat roller. The press belt pressing type fixing device basically includes a heat roller which is heated by a heat source such as a halogen lamp and axially rotates, an endless press belt which contacts the heat roller and is moved by a motion of the heat roller, and a pressing element which presses an inner surface of the press belt toward the surface of the heat roller so that an outer surface of the press belt corresponding to the pressed inner surface contacts the heat roller. As described in Japanese Patent Publication No. 2004-12682, the entire disclosure of which is hereby incorporated by reference, the fixing nip is wide because it is formed by pressing the press belt on the heat roller so that they contact each other. Accordingly, the warm-up time and power consumption can be reduced, and component costs can be reduced from those required by the IH fixing device. However, because the inner surface of the press belt is pressed by the pressing element and slides on the heat roller, the durability of the press belt or the pressing element is still restricted due to abrasion of the heat roller on which the press belt slides, and the selection range of a material for the press belt or the pressing element is still narrow.

Additionally, a heat belt type fixing device includes a cylindrical heat belt unit comprising an endless heat belt which is freely movable in a main direction is included instead of the heat roller included in the 2-roller type fixing device. A fixing nip is formed by contacting the heat belt with a cylindrical press roller with pressure. The heat belt type fixing device basically includes the heat belt unit manufactured by winding the endless heat belt on a support roller and the cylindrical heat roller. The cylindrical press roller presses a bridging portion of the heat belt ranging between the support roller and the heat roller to contact the bridging portion. A halogen lamp is installed in the heat roller or the press roller. In the heat belt type fixing device, a wide fixing nip is formed, so that the warm-up time and power consumption can be reduced. Furthermore, because no sliding occurs, no abrasion occurs. Therefore, numerous materials for the heat belt can be used. In addition, as described in Japanese Patent Publication No. 2004-205877, the entire disclosure of which is hereby incorporated by reference, component costs can be less than those for the IH fixing device.

However, because the heat belt in the heat belt type fixing device is supported by the support roller, and the heat roller and is tensed, when the heat belt is rotated it moves toward the shaft of the support roller. Alternatively, the heat roller may tilt due to an error due to size accuracy, assembly accuracy of each roller, or a widthwise deviation of the circumference of the heat belt.

Since a color toner image is formed by stacking toner layers of a plurality of colors, the image may be difficult to fuse. Thus, an offset phenomenon may occur where the toner image partially separates. In the above-described conventional fixing devices, when the heat belt or heat roller having residual toner attached thereto rotates and contacts the sheet, the residual toner attaches to the sheet, resulting in image degradation.

Accordingly, there is a need for an improved image forming apparatus including a fixing device which can reduce warm-up time, power consumption, and tilting of a belt to improve image quality.

SUMMARY OF THE INVENTION

An aspect of the present invention is to address at least the above problems and/or disadvantages and to provide at least the advantages described below. Accordingly, an aspect of the present invention is to provide a fixing device which can reduce warm-up time, power consumption, and tilting of the belt to improve image quality and an image forming apparatus including the fixing device.

According to an aspect of the present invention, there is provided a fixing device including at least two supporters, an endless belt movably supported by the supporters in a main direction, a heat source which heats the endless belt, and a pressing element which presses on the endless belt to fuse and fix a toner image to a recording medium when the recording medium is passed through a fixing nip formed between the belt and the pressing element. Two bridging portions of the belt extend between the supporters. One bridging portion is tensed and the other bridging portion is tense-free. The fixing nip is formed by contacting the pressing element with an outer surface of the tensed bridging portion. The fixing device further includes a heat source which heats a rounding portion of the belt that is wound around one of the at least two supporters on an upstream side and a cleaning mechanism which cleans a surface of the rounding portion.

According to another aspect of the present invention, there is provided a fixing device including at least two supporters, an endless belt movably supported by the supporters in a main direction, an electrical heating element pressed on the endless belt, and a heat source which heats the electrical heating element to fuse and fix a toner image to a recording medium passing through a fixing nip formed between the belt and the electrical heating element. Two bridging portions of the belt extend between the supporters, one bridging portion is tensed, the other bridging portion is tense-free, and the fixing nip is formed by contacting the electrical heating element with an outer surface of the tensed bridging portion. The fixing device further includes a heat source which heats a rounding portion of the belt that is wound around a supporter on an upstream side and a cleaning mechanism which cleans a surface of the rounding portion.

According to another aspect of the present invention, there is provided an image forming apparatus including an image forming unit which electrostatically transfers a toner image onto a recording medium and the former fixing device.

According to another aspect of the present invention, there is provided an image forming apparatus including an image forming unit which electrostatically transfers a toner image onto a recording medium, and the latter fixing device.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
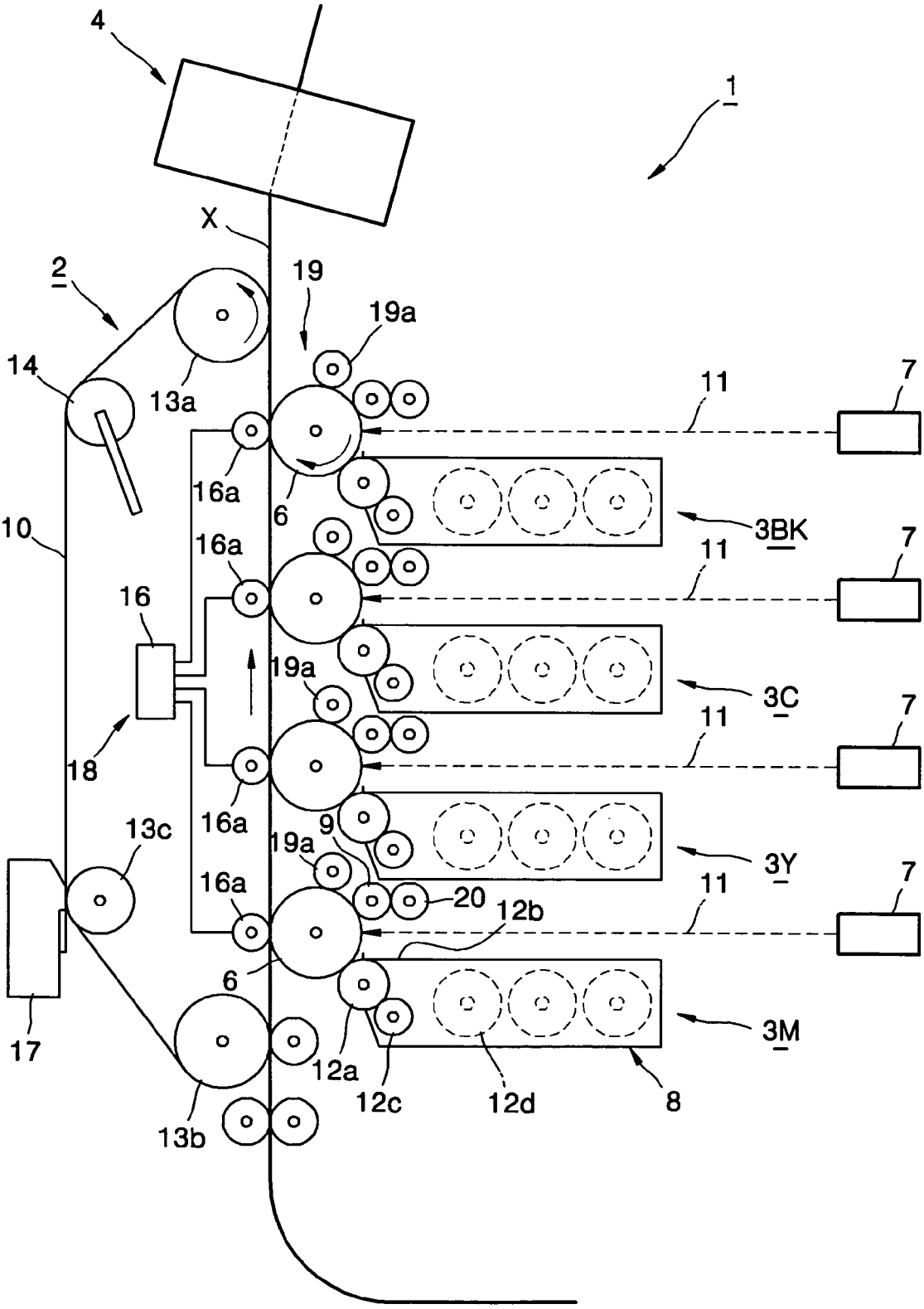
FIG. 1 is a schematic diagram of a fixing device and an image forming apparatus according to an embodiment of the present invention.

As shown in FIG. 1, the image forming apparatus 1 includes a transfer unit 2, a plurality of image forming units 3M, 3Y, 3C, and 3BK installed on the transfer unit 2 to electrostatically transfer a toner image to a sheet (recording medium) X, such as paper, and a fixing device 4 for fusing and fixing the toner image onto the sheet X while carrying the sheet X having the toner image formed thereon.

The image forming units 3M, 3Y, 3C, and 3BK charge a photoconductor drum (image carrier) 6, perform exposure to form a latent image by scanning the surface of the charged photoconductor drum 6 with laser light 11, develop the latent image to form a toner image, and transfer the toner image to the sheet X transferred by a transfer belt 10. The image forming units 3M, 3Y, 3C, and 3BK are sequentially arranged along the transfer belt 10 in the direction of the sheet X transferred by the transfer belt 10 to form toner images of magenta, yellow, cyan, and black colors, respectively. Each of the image forming units 3M, 3Y, 3C, and 3BK includes a photoconductor drum 6, an exposure device 7, a developer 8, a charging roller 9, and a cleaning unit 19.

The photoconductor drum 6, which is an image carrier, axially rotates in the direction indicated by an arrow shown in FIG. 1 and is scanned with the laser light 11 emitted from the exposure device 7 to form a latent image. The exposure device 7 scans the surface of the photoconductor drum 6 with the laser light 11 in the direction parallel to the rotational axis of the photoconductor drum 6.

The developer 8 develops the latent image to form the toner image. More specifically, the developer 8 rubs powdered toner having a predetermined color with each other to charge the same with negative charges and provides and attaches the charged toner to exposed portions of the photoconductor drum 6 that have positive potentials compared to potentials of non-exposed portions thereof. The developer 8 includes toner, an agitator 12*d* for agitating the toner to charge the same with charges, and a supply roller 12*c* for transferring the charged toner to a developing roller 12*a*. The developing roller 12*a* has toner supplied by the supply roller 12*c* attached to its surface by a coulomb force generated by the charges of the toner for transferring the toner to the photoconductor drum 6 to form a toner layer. A developing blade 12*b* restricts a thickness of the toner layer to a predetermined thickness.

The cleaning unit 19 includes a photoconductor drum cleaning roller 19*a* and a housing (not shown). The cleaning roller 19*a* comes into contact with the photoconductor drum 6 to remove toner from the surface of the photoconductor drum 6. The housing is installed near the cleaning roller 19*a* to collect the toner removed by the cleaning roller 19*a*.

The charging roller 9 changes a surface potential of the photoconductor drum 6 to a predetermined potential during image formation. The charging roller 9 includes a metal shaft and a roller portion formed of a conductive elastic body on the metal shaft and contacts the photoconductor drum 6 at a charging location on the downstream side of the photoconductor drum cleaning roller 19*a*. By pressing a bearing (not shown) using an elastic bias unit, such as a spring, the charging roller 9 is pressed on the photoconductor drum 6 with a predetermined pressure. As a result, the roller portion of the charging roller 9 is deformed to form a nip contacting the photoconductor drum 6 by a predetermined width in the main direction. When receiving a direct current voltage, the charging roller 9 charges the surface of the photoconductor drum 6 to have a predetermined potential. A charging roller cleaning roller 20 comes into contact with the charging roller 9 to prevent contamination of the surface of the charging roller 9.

The transfer unit 2 includes an endless transfer belt 10, a driving roller 13*a*, transfer rollers 16*a*, and a belt cleaning unit 17. The endless transfer belt 10 is circulated in one direction by driven rollers 13*b* and 13*c* and a tension roller 14, which are installed on an inner circumference of the transfer unit 2. The transfer rollers 16*a* keep the contact of the transfer belt 10 with the photoconductor drums 6 at a transferring location. The belt cleaning unit 17 includes a cleaning blade (not shown) for scraping extraneous matter off the surface of the transfer belt 10 and a space (not shown) for collecting the removed extraneous matter.

The transfer belt 10 is, for example, a dielectric sheet that can attract the toner on the photoconductor drum 6 by a transfer voltage applied to the transfer roller 16*a* when the sheet X exists between the transfer belt 10 and the photoconductor drum 6. The transfer belt 10 has an optical reflection property, that is, reflects light.

The transfer roller 16*a* is manufactured by forming a roller unit which may be formed of conductive or semi-conductive synthetic rubber on a metal rotational shaft. A transfer high-voltage source (not shown) is connected to the rotational shaft to control a surface potential of the roller unit.

The transfer roller 16*a* and a controller 16 for controlling the surface potential of the rolling unit of the transfer roller 16*a* constitutes a transfer portion 18 for electrostatically transfer the toner images formed by the image forming units 3M, 3Y, 3C, and 3BK to the sheet X carried by the transfer belt 10.

Figure 2:
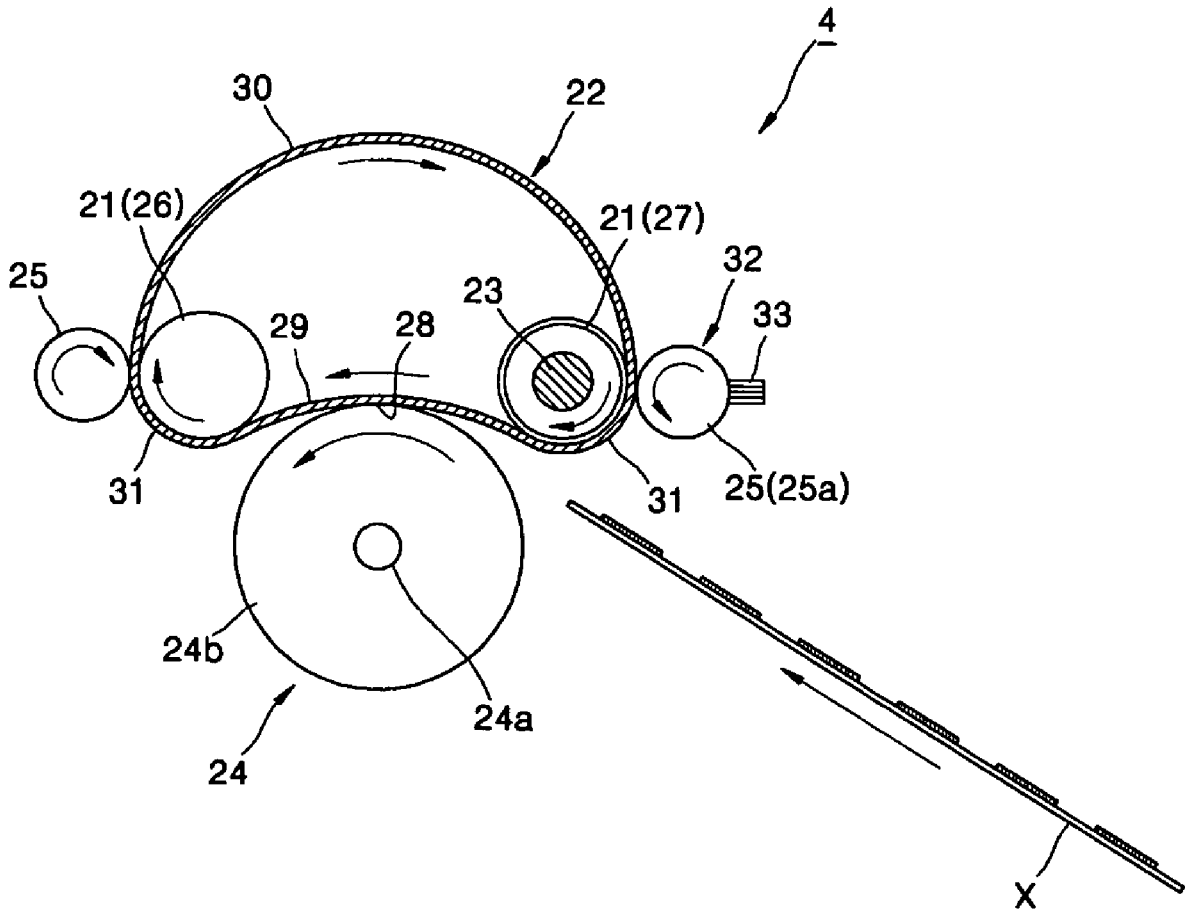
FIG. 2 is a schematic diagram of the fixing device shown in FIG. 1.

The fixing device 4 will now be described in greater detail with reference to FIG. 2. As shown in FIG. 2, the fixing device 4 includes two supporters 21, an endless (cylindrical) fixing belt 22 movably supported by the supporters 21 in the main direction, a heat source 23 for heating the fixing belt 22, a pressing element 24 for pressing the fixing belt 22 to come in contact with the same, a pinch element 25 installed on the lateral side of each of the supporters 21, and a cleaning mechanism 32 for cleaning a surface of the fixing belt 22.

The supporters 21, each having a shape of a cylinder capable of axially rotating in one direction, are installed inside the cylindrical fixing belt 22. The fixing belt 22 is wound around parts of the supporters 21. The supporters 21 are disposed near the pressing element 24 but apart therefrom, that is, disposed on the upstream side (which is the right side of FIG. 2) and downstream side (which is the left side of FIG. 2) of the transfer direction of the sheet X. The supporter 21 on the downstream side corresponds to a driving roller 26, which is axially rotated by a driving mechanism (not shown). The supporter 21 on the upstream side corresponds to a guide roller 27, which resists the motion of the fixing belt 22 in the main direction with a rotational resistance.

The fixing belt 22 has a length greater than a width of the sheet X and a substantially cylindrical shape when no external forces are applied. The fixing belt is supported by the driving roller 26 and the guide roller 27 installed inside the fixing belt 22. The fixing belt 22 is manufactured by sequentially stacking an elastic layer formed of heat-resistant rubber, such as silicon, to a thickness of about several hundreds of microns and a toner release layer formed of highly heat-resistant fluorine resin or a modified material of fluorine resin, such as polytetrafluoroethylene, to a thickness of about several tens of microns on a base layer formed of a metal or heat-resistant resin film having a thickness of about 10 to 150 microns.

An inner surface of the fixing belt 22 rubs against and contacts the driving roller 26. The fixing belt 22 moves in the main direction via the axially rotating driving roller 26. The guide roller 27, for example the supporter 21 on the upstream side, has a resistance against the main-directional movement of the fixing belt 22. A bridging portion 29 of the fixing belt 22, which ranges between the driving roller 26 and the guide roller 27, is tensed, while the other bridging portion 30 of the fixing belt 22, which also ranges between the driving roller 26 and the guide roller 27, is not tensed.

The heat source 23 is a halogen lamp. The heat source 23 includes a main body installed within the supporter 21 on the upstream side, for example guide roller 27, and heats the guide roller 27 using radiant heat emitted by the main body. Heat emitted from the heated guide roller 27 is transferred to a rounding portion 31 of the fixing belt 22 which is wound around the guide roller 27 to thereby heat the fixing belt 22.

The pressing element 24 is substantially cylindrically shaped and axially rotatable in one direction. The pressing element 24 is manufactured by winding a heat-resistant elastic layer 24*b*, such as a silicon rubber layer, around a metallic core base 24*a*. The pressing element 24 is installed so as to always mechanically press the lengthwise center of the tensed bridging portion 29. An arched fixing nip 28 is formed between the pressing 24 and the bridging portion 29. A tangential pressure is exerted upon the fixing nip 28 by a tension of the tensed bridging portion 29, so that the toner image seated on the sheet X is pressed while passing through the fixing nip 28. The pressing element 24 is axially rotated by the fixing belt 22 moving in a main direction, because it presses and directly contacts the outer circumferential surface of the fixing belt 22.

Each of the pinch elements 25 has a cylindrical shape and is axially rotatable in one direction. Each pinch element is installed on the outer surface of the fixing belt 22 and near each of the supporters 21 so that the rounding portion 31 of the fixing belt 22 side is pressed between the pinch element 25 and each of the supporters 21. Each of the pinch elements 25 is also axially rotated by moving fixing belt 22, because it is located to press and directly contact the outer circumferential surface of the rounding portion 31 of the fixing belt 22.

The cleaning mechanism 32 includes the pinch element 25 on the upstream side, for example proximate the location of the cleaning element 25*a*, and a removal element 33 having a pad or rotational brush shape, pressed by the cleaning element 25*a*. In addition to pressing the fixing belt 22 on the supporter 21 on the upstream side, the pinch element 25 on the upstream side removes residual toner from the surface of the fixing belt 22 because it presses and contacts the surface of the rounding portion 31 of the fixing belt 22. At least a surface layer of the pinch element 25 on the upstream side is formed of a highly insulative material to which residual toner, such as silicon rubber, is easily attached. The removal element 33 scrapes residual toner or other matters off the cleaning element 25*a*. Preferably, the cleaning mechanism further includes a basin that receives the residual toner or other matters scraped by the removal element 33.

An operation of the image forming apparatus 1 having the aforementioned structure will now be described in detail. Because the entire operation of the image forming apparatus 1 is substantially the same as an operation of a well-known color printer, many parts except an operation of the fixing device 4 will be omitted for clarity and conciseness.

First, when the image forming apparatus 1 is manipulated, the heat source 23 is driven to perform a warm-up process to start heating. More specifically, heating is continued until the temperature of the fixing device 4 reaches a predetermined fixing temperature. At this time, the driving roller 26 is axially rotated by a driving mechanism (not shown), and simultaneously the fixing belt 22 is moved by the rotating driving roller 26 in the main direction. When the fixing belt 22 moves, the guide roller 27, the pinch element 25, and the pressing element 24 are axially rotated by the moving fixing belt 22. Because the temperature of the image forming apparatus 1 increases due to radiation of heat by the fixing device 4, a fan (not shown) generates forced convection around the fixing device 4 to cool the inside of the image forming apparatus 1.

Next, when the temperature of the fixing device 4 reaches the predetermined fixing temperature, the image forming units 3M, 3Y, 3C, and 3BK start forming images on the sheet X transferred by the transfer belt 10. More specifically, the surface of the photoconductor drum 6 charged by the charging roller 9 is scanned with the laser light 11 to form a latent image. The latent image is developed by the developer 8 to form a toner image. The toner image formed on the surface of the photoconductor drum 6 is transferred to the sheet X transferred by the transfer belt 10.

Thereafter, the sheet X on which the toner image is seated is transferred to the fixing device 4, and the toner image is fused and fixed to the sheet X while the sheet X passes between the fixing belt 22 and the pressing element 24. More specifically, the sheet X on which the toner image is seated is carried within the fixing nip 28 from the upstream side, that is the right side of FIG. 2. The toner image on the sheet X within the fixing nip 28 is fused by the heated fixing belt 22 and pressed on and fixed to the sheet X by the pressing element 24. The sheet X to which the toner image is fixed is carried out of the fixing nip 28 through the downstream side, that is the left side in FIG. 2.

When residual toner is attached to the fixing belt 22, due to offset phenomenon occurring during image fixing, the residual toner is transferred to the pinch element on the upstream side by the fixing belt 22 moving in the main direction and fused by the guide roller 27 heated by the heat source 23. The fused residual toner is peeled off by the cleaning element 25*a* pressing and contacting the fixing belt 22 and attaches to the cleaning element 25*a*. Now, the residual toner on the fixing belt 22 is completely removed. The residual toner attached to the cleaning element 25*a* is scraped off by the removal element 33.

In the fixing device 4, because the pressing element 24 presses and contacts the tensed bridging portion 29 of the fixing belt 22 ranging between the two supporters 21, the wide fixing nip 28 is formed between the two supporters 21. Thus, a long period of fixing time can be secured, and sufficient fixing is possible. Furthermore, because the fixing belt 22 which is heated has a low-heat capacity, the warm-up time and power consumption can be reduced. Moreover, because the bridging portion 30 not contacting the pressing element 24 is tension-free, the bridging portion 30 can absorb a deformation of the fixing belt 22 or a motion of the fixing belt 22 that is caused by a distortion of the cross-sectional shapes of the supporters 21 or by other matters. Thus, the fixing belt 22 is prevented from moving in the axial direction of the supporters 21. Further, because the fixing device 4 is not comprised of expensive components, it is more economical.

In the fixing device 4, because the heat source 23 is used to heat the rounding portion 31 of the fixing belt 22 wound around the supporter 21 on the upstream side, and the cleaning mechanism 32 is used to clean the surface of the heated rounding portion 3 1, residual toner or dust such as paper powder can be removed from the surface of the fixing belt 22, thereby preventing the quality of image from being degraded by residual toner. Also, because the offset phenomenon relatively easily occurs upon fixing of a color toner image formed by stacking a plurality of colors, for example, magenta, yellow, cyan, and black, the fixing device 4 is particularly effective for color printing.

Due to the use of the fixing device 4 that reduces warm-up time, power consumption, tilting of the fixing belt 22, and the possibility of occurrence of offset phenomenon, and cost-efficiency, the image forming apparatus 1 can provide shortened warm-up time and reduced power consumption, improve the quality of image due to the prevention of offset, and prevents mechanical defects even with low costs.

The two supporters 21 for supporting the fixing belt 22 each include the driving roller 26 and the guide roller 27, which are axially rotatable, and the pressing element 24. The pressing element 24 presses and contacts the bridging portion 29 of the fixing belt 22 and has a shape of an axially rotatable roller. Thus, no sliding occurs on the fixing belt 22, and the fixing belt 22 does not abrade.

A fixing device 104, and an image forming apparatus including the fixing device 104 according to another embodiment of the present invention, will now be described with reference to FIG. 3. The same elements as those in the previous embodiment will not be described herein.

Figure 3:
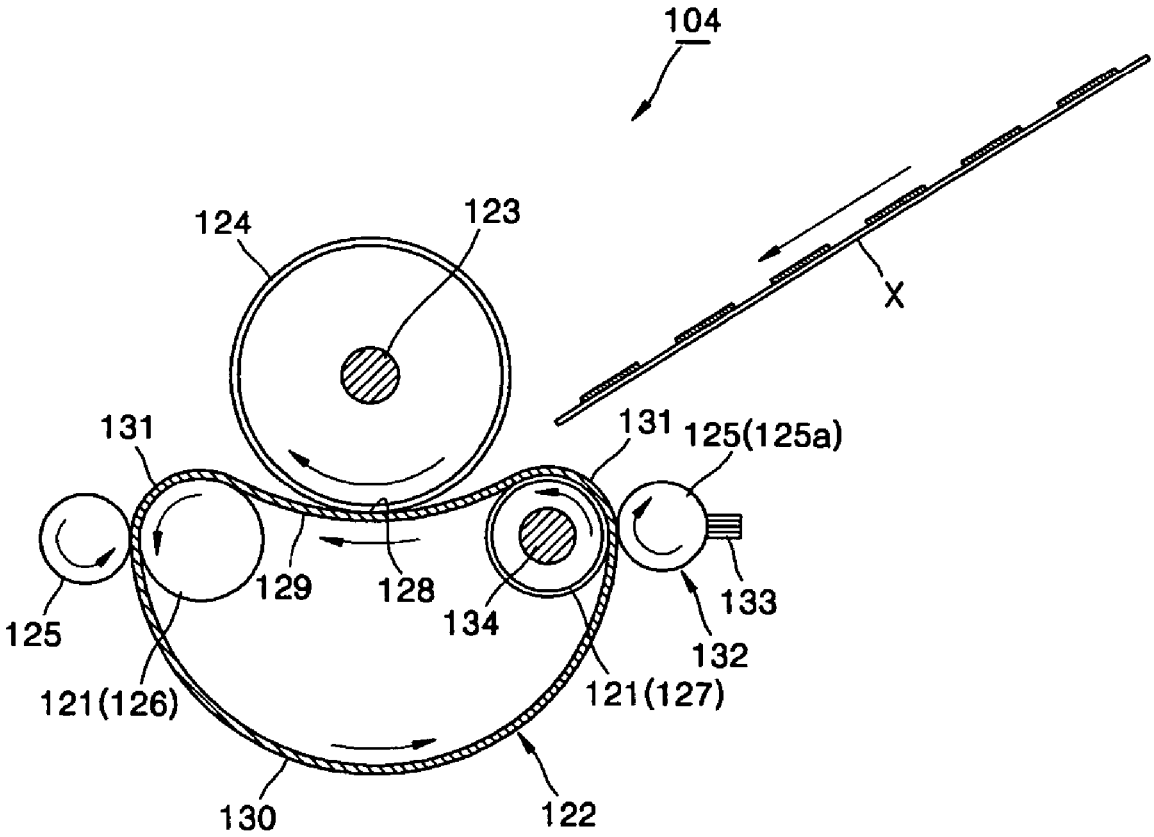
FIG. 3 is a schematic diagram of a fixing device according to another exemplary embodiment of the present invention.

As shown in FIG. 3, the fixing device 104 is manufactured by replacing the supporters 21, the fixing belt 22, and the pinch element 25 of the fixing device 4 with a cylindrical electrical heating element 124 and replacing the pressing element 24 of the fixing device 4 with supporters 121, a fixing belt 122, and pinch elements 125.

The fixing device 104 includes the two supporters 121, the endless (cylindrical) fixing belt 122 supported by the supporters 121 to be movable in the main direction, the electrical heating element 124 pressing and contacting the fixing belt 122, a first heat source 123 for heating the electrical heating element 124, the pinch elements 125 installed on the lateral sides of the supporters 121, a cleaning mechanism 132 for cleaning a surface of the fixing belt 122, and a second heat source 134 for heating the supporter 121 on the upstream side proximate the guide roller 127 to heat rounding portions 131 of the fixing belt 122 wound around the supporter 121.

The electrical heating element 124 has a shape of a cylinder and is axially rotatable in one direction. The electrical heating element 124 is preferably formed of a highly thermal conductive material, such as aluminium, stainless steel, or iron. The electrical heating element 124 is coated with highly heat-resistant fluorine resin or a modified material of fluorine resin to prevent toner from being attached to the surface of the electrical heating element 124. The electrical heating element 124 is installed to always mechanically press the lengthwise center portion of a tensed bridging portion 129. An arched fixing nip 128 is formed between the electrical heating element 124 and the bridging portion 129.

The first heat source 123 is a halogen lamp. The first heat source 123 includes a main body installed within the electrical heating element 124 and heats the electrical heating element 124 using radiant heat emitted by the main body.

The cleaning mechanism 132 includes the pinch element 125 on the upstream side near the cleaning element 125*a* and a removal element 133 such as a pad or rotational brush which is pressed by the cleaning element 125*a*.

For example, the second heat source 134 is a halogen lamp. The second heat source 134 includes a main body installed within the cylindrical supporter 121 on the upstream side and heats the guide roller 127 using radiant heat emitted by the main body. Heat emitted from the heated guide roller 127 is transferred to the bridging portion 131 of the fixing belt 122 that contacts the guide roller 127, and thus the bridging portion 131 is heated.

In the fixing device 104, when residual toner attached to the electrical heating element 124 is removed and attached to the fixing belt 122 via the fixing nip 128 due to offset phenomenon, residual toner attached to the bridging portion 131 of the fixing belt 122 is peeled off by the cleaning element 125*a*. Therefore, residual toner or dust such as paper powder, on the fixing belt 22 can be removed. Thus, contamination of the sheet X due to attachment of residual toner or other matters to the side of the sheet X other than a side where an image is formed.

While the present invention has been particularly shown and described with reference to the above-described embodiments, it will be understood by those of ordinary skill in the art that various changes in form and details may be made therein without departing from the spirit and scope of the present invention as defined by the following claims. For example, in the embodiment of FIG. 2, the heat source 23 installed within the supporter 21 on the upstream side heats and fuses both the toner image seated on the sheet X and the residual toner attached to the fixing belt 22. However, a heat source for heating and fusing a toner image seated on a sheet and a heat source for heating and fusing residual toner attached to a fixing belt may be separately installed. For example, in addition to a heat source installed within a supporter on the upstream side, another heat source may be installed inside an endless fixing belt.

In the embodiments of FIGS. 2 and 3, the heat sources 23 and 134 are installed within the supporters 21 and 121, respectively, on the upstream side to be apart from inner circumferential surfaces thereof and heat the supporters 21 and 121 on the upstream side using radiant heat. However, a heat source may be installed in contact with a supporter on the upstream side to directly heat the supporter. Alternatively, a heat source for heating a pinch element such as a cleaning element which contacts a rounding portion of a fixing belt on the upstream side may be installed.

In the embodiments of FIGS. 2 and 3, the two supporters 21 (121) are installed on the upstream and downstream sides of the transfer of the sheet X. However, more than two supporters may be installed. If three supporters are installed, supporters on the upstream and downstream sides may be guide rollers, and the other supporter may be a driving roller.

In the embodiments of FIGS. 2 and 3, the guide rollers 27 and 127, namely, the supporters 21 on the upstream side have rotational resistance and resist main-direction motions of the fixing belts 22 and 122, respectively, to tense the bridging portions 29 and 129 and loosen the bridging portions 30 and 130. However, one bridging portion may be tensed and the other may be loosened by axially rotating a supporter on the downstream at a higher linear speed than that for a supporter on the upstream side using a driving mechanism. Thus, smoothing an outer circumferential surface of the supporter on the upstream side more than that of the supporter on the downstream side, and rubbing a fixing belt and the supporter on the downstream side against each other more strongly than for the fixing belt and the supporter on the upstream side.

In the embodiments of FIGS. 2 and 3, the supporters 21 and 121 have shapes of axially rotatable rollers. However, an arched supporter may be installed to be fixed and to enable a belt to slide thereon. The shape of a supporter may appropriately vary. Additionally, while a heat source for heating a bridging portion of a belt and a supporter on the upstream side are separately installed, a supporter having a heating function may be used instead of using both the heat source and the supporter on the upstream side.

In the embodiment of FIG. 2, the pressing element 24 has a shape of an axially rotatable roller. However, an arched pressing element may be installed to be fixed and to enable a belt to slide thereon. The shape of a pressing element may appropriately vary.

In the embodiment of FIG. 3, the electrical heating element 124 has a shape of an axially rotatable roller. However, an arched electrical heating element may be installed to be fixed and to enable a belt to slide thereon. The shape of an electrical heating element may appropriately vary.

In the embodiments of FIGS. 2 and 3, the pinch elements 25 and 125 on the downstream side each have a shape of an axially rotatable roller. However, an arched pinch element may be installed to be fixed and to enable a belt to slide thereon. The shape of a pinch element may appropriately vary.

In the embodiments of FIGS. 2 and 3, the pinch elements 25 and 125 on the upstream side serve as cleaning elements

25*a* and 125*a*, respectively, for cleaning the fixing belts 22 and 122, respectively. However, a pinch element on the upstream side and a cleaning element for cleaning a fixing belt may be separately installed.

In the embodiments of FIGS. 2 and 3, the pinch elements 25 and 125 are installed on the lateral sides of the supporters 21 and 121, respectively. However, pinch elements do not necessarily have to be installed. Also, in these embodiments, the supporters 21 and 121 on the upstream and downstream sides are separated from the pressing element 24 and the electrical heating element 124, respectively. However, supporters on both sides may be pressed by a pressing element or an electrical heating element to contact each other. In this case, it is not necessary to install two pinch elements for both sides, but a cleaning element for cleaning a fixing belt is installed on the upstream side. Alternatively, a supporter on one of the upstream and downstream sides may be pressed by the pressing element or the electrical heating element to contact each other, while the other supporter may be separated from the pressing element or the electrical heating element. In this case, only one pinch element is utilized, however, other suitable arrangements may be used. If the supporter on the upstream side is pressed by the pressing element or the electrical heating element into contact with one other, a cleaning element for cleaning the fixing belt is installed on the upstream side. If the cleaning element is formed of a material by which a surface release of the cleaning element can be lower than that of the fixing belt with respect to toner, the removal elements 33 and 133 may be omitted.

In the embodiments of FIGS. 2 and 3, the image forming apparatus 1 includes the plurality of image forming units 3M, 3Y, 3C, and 3BK to achieve color printing. However, an image forming apparatus according to the exemplary embodiments of the present invention may perform monochromic printing by including only one image forming unit. Also, since the fixing nip 30 is wide enough to lengthen the heating and fusing time, it is particularly effective for color-printing apparatuses in which a color toner image which is difficult to fuse is to be fixed to a recording medium.

A recording medium is not limited to the sheet X but may be a plate-shaped recording medium. The shape and material of the recording medium may adequately vary.

While the invention has been shown and described with reference to certain embodiments thereof, it will be understood by those skilled in the art that various changes in form and details may be made therein without departing from the spirit and scope of the invention as defined by the appended claims.

What is claimed is:

1. A fixing device, comprising:

at least two supporters;

an endless belt movably supported by the supporters in a main direction and comprising two bridging portions;

a heat source which heats a rounding portion of the endless belt that is wound around of the supporter on an upstream side of the belt;

a pressing element which presses on the endless belt to fuse and fix a toner image to a recording medium passing through a fixing nip formed between the belt and the pressing element; and a cleaning mechanism which cleans a surface of the rounding portion;

wherein the two bridging portions of the belt extend between the supporters, one of the bridging portions is tensed and the other bridging portion is tense-free, and the fixing nip is formed by contacting the pressing element with an outer surface of the tensed bridging portion.

2. The fixing device of claim 1, wherein the supporters are located on the upstream side and a downstream side of the belt, and the pressing element presses and contacts the tensed bridging portion ranging between one of the supporters on the upstream side and the supporters on the downstream side.

3. The fixing device of claim 2, wherein a pinch element is installed on a lateral side of each of the supporters to press and contact the supporters, and the belt is pressed between each of the supporters and each of the pinch elements.

4. The fixing device of claim 2, wherein the supporter on the downstream side rubs against and contacts the inner surface of the belt and drives the belt, and the other supporter on the upstream side is rotated by the moving belt.

5. The fixing device of claim 2, wherein a pinch element is installed on the lateral side of the supporter on the upstream side to press and contact the supporter, and the rounding portion of the belt is pressed between the supporter and the pinch element.

6. The fixing device of claim 5, wherein the cleaning mechanism comprises the pinch element installed on the upstream side and a removal element presses and contacts the pinch element.

7. The fixing device of claim 1, wherein the heat source which heats the rounding portion of the belt is installed within the supporter on the upstream side.

8. The fixing device of claim 1, wherein the fixing belt is a stack of at least an elastic layer that forms the fixing nip by compression and a toner release layer that comprises an outermost surface of the fixing belt.

9. The fixing device of claim 1, wherein each of the supporters has one shape of an axially rotatable roller and an arch that is fixed so that the belt slides on an outer circumferential surface of the arch.

10. A fixing device, comprising:

at least two supporters;

an endless belt movably supported by the supporters in a main direction and comprising two bridging portions;

an electrical heating element pressed on the endless belt;

a heat source, which heats the electrical heating element to fuse and fix a toner image to a recording medium while passing the recording medium on which the toner image is electrostatically seated through a fixing nip formed between the belt and the electrical heating element and which heats a rounding portion of the belt that is wound around of the supporter on an upstream side of the belt; and a cleaning mechanism, which cleans a surface of the rounding portion;

wherein the two bridging portions of the belt extend between the supporters, one of the bridging portions is tensed, the other bridging portion is tense-free, and the fixing nip is formed by contacting the electrical heating element with an outer surface of the tensed bridging portion.

11. The fixing device of claim 10, wherein the supporters are located on the upstream side and a downstream side of the belt, and the electrical heating element presses and contacts the tensed bridging portion ranging between the supporter on the upstream side and the supporter on the downstream side.

12. The fixing device of claim 11, wherein a pinch element is installed on a lateral side of each of the supporters to press and contact the supporters, and the belt is pressed between each of the supporters and each of the pinch elements.

13. The fixing device of claim 11, wherein the supporter on the downstream side rubs against and contacts the inner surface of the belt and drives the belt, and the supporter on the upstream side is rotated by the moving belt.

14. The fixing device of claim 11, wherein a pinch element is installed on the lateral side of the supporter on the upstream side to press and contact the supporter, and the rounding portion of the belt is pressed between the supporter and the pinch element.

15. The fixing device of claim 14, wherein the cleaning mechanism comprises the pinch element installed on the upstream side and a removal element pressing and contacting the pinch element.

16. The fixing device of claim 10, wherein the heat source which heats the rounding portion of the belt is installed within the supporter on the upstream side.

17. The fixing device of claim 10, wherein the fixing belt comprises a stack of at least an elastic layer that forms the fixing nip by compression and a toner release layer that comprises an outermost surface of the fixing belt.

18. The fixing device of claim 10, wherein each of the supporters has one shape of an axially rotatable roller and an arch that is fixed so that the belt slides on an outer circumferential surface of the arch.

* * * * *